US006210650B1

(12) United States Patent
Karner et al.

(10) Patent No.: US 6,210,650 B1
(45) Date of Patent: Apr. 3, 2001

(54) PROCESS FOR REGENERATING HYDROCHLORIC ACID FROM PICKLING PLANTS

(75) Inventors: Wilhelm Karner, Eichgraben; Dietfried Gamsriegler, Wiener Neustadt, both of (AT)

(73) Assignee: Andritz-Patentverwaltungs-Gesellschaft m.b.H, Graz (AT)

( * ) Notice: Subject to any disclaimer, the term of this patent is extended or adjusted under 35 U.S.C. 154(b) by 0 days.

(21) Appl. No.: 08/280,945

(22) Filed: Jul. 27, 1994

(30) Foreign Application Priority Data

Jul. 27, 1993 (AT) ..... 1449/93

(51) Int. Cl.[7] ..... C01B 7/01; C01B 7/03; C23F 1/46; C23G 1/36

(52) U.S. Cl. ..... 423/488; 423/138; 423/493; 423/DIG. 1; 423/241; 216/93

(58) Field of Search ..... 423/138, 481, 423/488, 493, DIG. 1, 241; 156/642; 216/93

(56) References Cited

U.S. PATENT DOCUMENTS

| | | | | |
|---|---|---|---|---|
| 2,838,373 | * | 6/1958 | Stricker | 423/DIG. 1 |
| 3,399,964 | * | 9/1968 | Michels et al. | 423/DIG. 1 |
| 3,445,284 | * | 5/1969 | Robinson, Jr. et al. | 423/DIG. 1 |
| 3,529,931 | * | 9/1970 | Moklebust | 423/481 |
| 3,682,592 | * | 8/1972 | Kovacs | 423/488 |
| 3,755,090 | * | 8/1973 | Jackson et al. | 205/98 |
| 4,086,321 | * | 4/1978 | Holley et al. | 423/488 |
| 4,397,708 | * | 8/1983 | Frantzen | 156/642 |
| 4,842,834 | * | 6/1989 | Burton | 423/235 |
| 5,098,680 | * | 3/1992 | Fellows et al. | 423/235 |

FOREIGN PATENT DOCUMENTS

| | | | | |
|---|---|---|---|---|
| 1-129982 | * | 5/1989 | (JP) | 156/642 |
| 5-25663 | * | 2/1993 | (JP) | 156/642 |
| 1401014 | * | 6/1988 | (SU) | 423/493 |

OTHER PUBLICATIONS

Conners, "Hydrochloric Acid Regeneration . . . Industries", CIM Bulletin, Feb. 1975 pp. 75–81.*

* cited by examiner

*Primary Examiner*—Ngoc-Yen Nguyen
(74) *Attorney, Agent, or Firm*—Alix, Yale & Ristas, LLP

(57) ABSTRACT

In order to reduce pollutants in the waste gas of regeneration plants for spent hydrochloric acid from pickling plants a process is provided, comprising the thermal decomposition of iron chloride in the spent pickling acid to iron oxide and gaseous hydrochloric acid, wherein to the spent pickling acid at least one compound is admixed which contains nitrogen having a low oxidation number, for example ammonium compounds, ammonia, urea or amides.

33 Claims, 2 Drawing Sheets

PROCESS FOR REGENERATING HYDROCHLORIC ACID FROM PICKLING PLANTS

BACKGROUND OF THE INVENTION

The present invention relates to a process for regenerating hydrochloric acid from pickling plants, in which iron chloride in the spent pickling acid is thermally decomposed into iron oxide and gaseous hydrochloric acid.

In metallurgical technology for the manufacture of steel products pickling represents an essential process step. In particular hydrochloric acid and sulfuric acid as well as other acid mixtures can be used as pickling media. Because of various circumstances, partly connected with the attainable quality of the final product, partly also with the fact of complete regenerability, pickling with hydrochloric acid or mixtures containing hydrochloric acid has gained increased importance in the last 30 years. The action of the acid resides in the dissolution of mill scale layers which are formed on the steel surface by preceding processes such as rolling, annealing etc. This takes place according to the following chemical reaction:

$$FeO+2HCl \rightarrow FeCl_2+H_2O \quad (1)$$

Accordingly, during pickling there takes place a consumption of acid (HCl) up to a point where the solution is saturated with iron chloride and can no longer be used for pickling.

It has been found that the consumed pickling acid and in particular the iron chloride contained therein can be decomposed by a thermal process, resulting on the one hand in the formation of iron oxide and wherein on the other hand hydrochloric acid is recovered which can be returned to the pickling process. This proceeds according to the following reaction:

$$2FeCl_2+2H_2O+0.5O_2 \rightarrow Fe_2O_3+4HCl \quad (2)$$

Two processes have gained significance for this step of thermal decomposition:

(a) the spray roasting process in which the consumed pickling acid including the iron chloride is sprayed into an empty reactor directly heated by burners, resulting in the formation of a fine dusty iron oxide, (b) the fluidized bed process in which the solution is injected into a fluidized bed reactor which contains a bed of spherical iron oxide particles which are maintained in suspension by the burner gases and the fluidization air, where a coarsely particulate iron oxide is formed.

Due to various side reactions undesirable gaseous side products which frequently entail poisonous pollutants and which by conventional technology can only be removed with difficulty or at great technological cost, may form in both processes.

Amongst these pollutants are the compounds NO and $NO_2$ (jointly denoted as oxides of nitrogen, $NO_x$) which on the one hand may be formed by the combustion process itself from atmospheric nitrogen, and on the other hand can be formed from nitrogen compounds added to the pickling bath, for example inhibitors.

A further pollutant is chlorine which, in the form of molecular chlorine ($Cl_2$) is formed in the aforesaid processes by oxidation of HCl according to the so-called Deacon equilibrium.

$$2HCl+0.5O_2 \rightarrow Cl_2+H_2O \quad (3)$$

The equilibrium constants of these homogeneous gas reactions are well known and are, for example, at

| Temperature (K) | log Kp |
|---|---|
| 500 | 0.9 |
| 600 | 0.7 |
| 700 | 1.9 |
| 800 | 2.8 |

From this, it can be seen that the equilibrium at lower temperatures tends predominantly towards the right of the equation even though on the other hand the reaction kinetics at such temperatures are too slow in order to bring about a substantial chlorine formation. At temperatures of about 700K such as corresponds more or less to the temperature of the flue gas from a spray roasting reactor, the chlorine concentration may be calculated as follows:

$$P_{Cl2}=Kp*(P_{HCl})^{2}*(P_{O2})^{0.5}/P_{H2O}$$

At an HCl content of e.g., 5% and an $O_2$ content of 3.5% as well as an $H_2O$ content of 45%—this corresponds to a typical composition of the reactor waste gas—there may be calculated therefrom a content of $Cl_2$ of about 35 ppm or 110 mg/m$^3$. These amounts of chlorine can vary according to the conditions, the oxygen surplus being a special deciding factor which frequently must be kept high in order to attain a predetermined oxide quality for fluidization.

The chlorine once formed can be removed only with difficulty from the waste gases. This step is, however, unavoidable since e.g., the technical regulations for air purity only permit a content of 5 mg/m$^3$. In the context of chlorine reduction, the washing with sodium thiosulfate for example forms part of the state of the art:

$$Na_2S_2O_3+4Cl_2+5H_2O \rightarrow 2NaHSO_4+8HCl \quad (4)$$

This manner of chlorine removal requires, however, expensive gas scrubbers and a corresponding consumption of chemicals. In addition, effluents are formed which have to be disposed of.

SUMMARY OF THE INVENTION

It is an object of the present invention to provide a simple and non-expensive process in which the formation of pollutants such as chlorine and oxides of nitrogen can be avoided during the recovery by thermal decomposition, of hydrochloric acid from spent pickling acids.

In accordance with the invention, there is admixed with the spent pickling acid at least one compound which contains nitrogen having a low oxidation number, for example ammonium compounds such as ammonium chloride, ammonia, urea or amides.

The pollutants $NO_x$ and chlorine act as oxidants in relation to the admixed substances so that they for example react in the following manner:

$$3NO+2NH_3 \rightarrow 2.5N_2+3H_2O \quad (5)$$

$$3NO_2+4NH_3 \rightarrow 3.5N_2+6H_2O \quad (5a)$$

$$3Cl_2+2NH_3 \rightarrow 6HCl+N_2 \quad (6)$$

During the reaction (5) part of the reactor and the iron oxide contained therein assumes the function of a catalytic converter.

According to a further feature of the invention, the spent pickling acid jointly with at least one compound containing nitrogen in a low state of oxidation is fed into a venturi scrubber thereafter to be thermally decomposed in a reactor, preferably a spray roasting reactor. This permits on the one hand the simple recovery of the hydrochloric acid and simultaneously the production of very pure oxide which, because of its structure, is excellently suited for further use.

Advantageously, the waste gas derived from the thermal decomposition is subjected to scrubbing, preferably with rinsing water from a rinsing plant downstream of a pickling plant, whereby the pollutant contents in the waste gas can be further reduced.

According to a further feature, in a process as described in the preceding paragraph, at least one compound which contains nitrogen in a low state of oxidation is added to the rinsing water prior to scrubbing the waste gases from the thermal decomposition offers the additional advantage that during such scrubbing all acid compounds and residual amounts of chlorine are removed by the nitrogenous compound in a chemical manner.

BRIEF DESCRIPTION OF THE DRAWINGS

The invention will be described below with reference to the accompanying drawings, in which.

DESCRIPTION OF THE PREFERRED EMBODIMENTS

Figure 1:
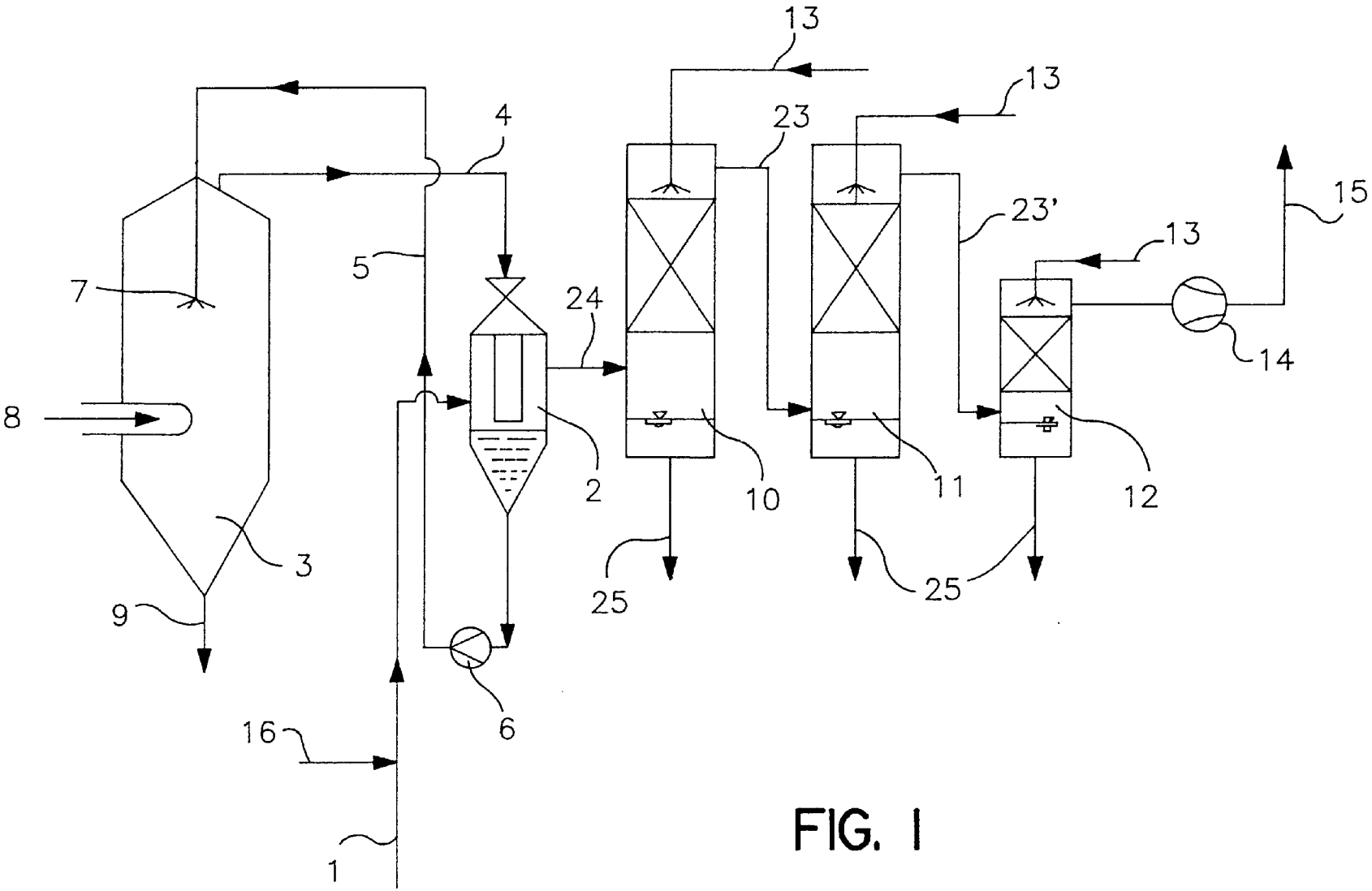
FIG. 1 is a schematic of one embodiment of the invention, in which waste gas from a thermal decomposition reactor is scrubbed with fresh water.
Figure 2:
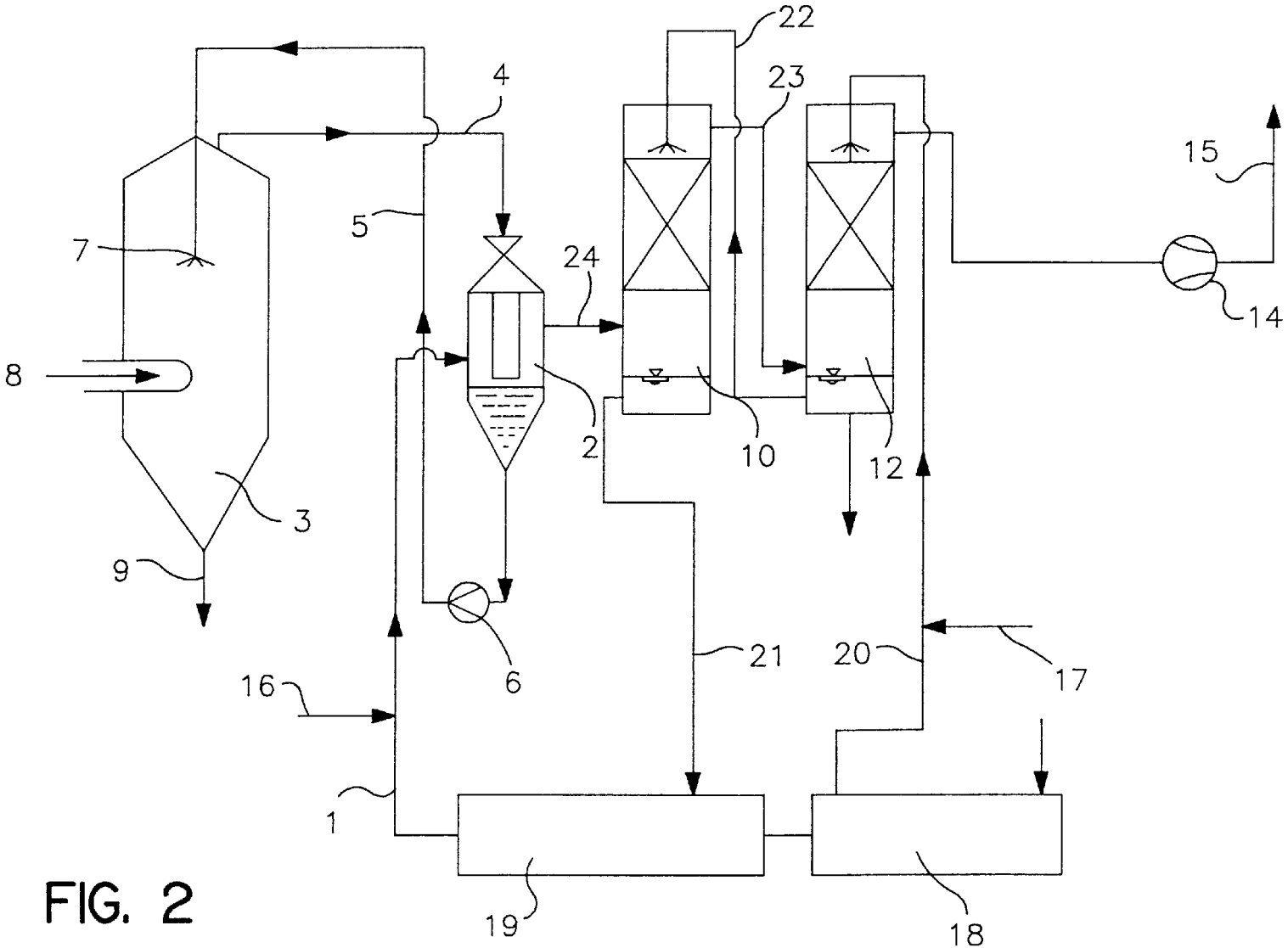
FIG. 2 is a schematic of another embodiment, in which waste gas from the thermal decomposition reactor is scrubbed using water from a downstream rinsing plant.

In the following description two preferred working examples of the process according to the invention are explained in more detail. In this context FIGS. 1 and 2 show schematically by way of example plants for carrying out the process according to the invention involving the use of a spray roasting reactor.

The spent pickling acid is introduced by way of a duct 1 into a Venturi scrubber 2. By way of a duct 4 the gases derived from the reactor 3, for example a spray roasting reactor, are passed into the venturi scrubber 2. The aqueous solution from the venturi scrubber 2 is passed by way of the pump 6 via a duct 5 to the spray means 7 of the reactor 3 which is supplied with gas and air for the combustion and oxidation by way of a duct 8. The oxide formed by the spray roasting process is withdrawn by way of a duct 9, from the reactor 3, preferably by way of a cellular wheel sluice.

The waste gas of the reactor 3 is henceforth fed after the Venturi scrubber 2 to a first column 10 and by way of the duct 23 to a second column 11 for further purification. Both columns 10, 11 are supplied by way of ducts 13 with water to which optionally chemicals may be added in order to support the purifying action, and the residual liquors are discharged by way of ducts 25.

The second column 11 is followed downstream by a scrubber 12 which is supplied with the waste gas by way of the duct 23' and fresh water by way of a duct 13 and from which the waste water is withdrawn by way of a duct 25. Thereafter, the purified waste gas is fed by way of a fan 14 to a flue 15 and discharged into the atmosphere.

The compounds respectively mixtures of compounds which contain nitrogen having a low state of oxidation are fed by way of the feed duct 1 for the spent pickling acid to the venturi scrubber 2 by way of a duct 16. In this context the rule applies as to the amount of introduced nitrogenous compounds that this must be admixed to the pollutants present at least in a stoichiometrical ratio, the attainable pollutant content in the waste gas being reduced in the same measure as the excess of nitrogenous compounds or a mixture thereof is increased. Depending on the starting values, at least the fivefold preferably, however, at least the tenfold amount is employed instead of the stoichiometrically required amount for the chlorine. In the case of nitrogen oxides the minimum amounts to be added are twice, preferably three times the stoichiometrically required amounts.

The plant according to FIG. 2 is designed similarly to that of FIG. 1, except that no second column is provided for. In order to represent a relationship to a source for the spent pickling acid, a rinsing plant 18 and the preceding pickling plant 19 are illustrated. The rinsing plant 18 is supplied by way of a duct 13 with fresh water, waste water with a residual amount of pickling acid contained therein being supplied by way of the duct 20 to the scrubber 12.

Into the duct 20 leading to the scrubber 12 the nitrogenous compound or the mixture of such compounds is admixed by way of another duct 17 to the water derived from the rinsing plant 18. The effect thereof is that elemental chlorine still present in the scrubber 12 enters into a chemical compound with the nitrogenous compound, for example with ammonia forming ammonium chloride, thereby being removed from the waste gas. The purified waste gas is thereafter once again discharged by way of a flue 15 into the atmosphere. The solution emerging from the first column and containing the hydrochloric acid formed during the thermal decomposition is passed by way of the duct 21 to the pickling plant 19.

If necessary, in order to further reduce pollutants, it is possible also in this process modification for a further compound, which contains nitrogen at a low oxidation level, to be admixed by way of a duct 16 directly to the spent pickling acid prior to the pickling acid entering into the venturi scrubber 2.

WORKING EXAMPLE A

Experiment 1:

In an experimental plant similar to that of FIG. 1, spent pickling acid of a steel producing plant was treated. The acid contained 119.4 g/l $Fe^{2+}$, 6.8 g/l $Fe^{3+}$ and altogether 224 g/HCl.

The feed rate of the Venturi scrubber amounted to 16 l/h and that of the spray roasting reactor 10 l/h. The temperature in the burner plane amounted to 645° C. and in the upper region of the reactor 389° C. The amount of gas was 2.8 $m^3$/h, the amount of air 28 $m^3$/h and the $O_2$ content 5% (based on dry volume). After the first column and without the addition of nitrogenous compounds, a content of $Cl_2$ of 24.6 mg/$m^3$ waste gas was determined.

Experiment 2:

The conditions as in Experiment 1 were set up. In the pickling acid which was fed to the venturi scrubber, 2.0 g/l ammonium chloride ($NH_4Cl$) were fed. The chlorine determination yielded no detectable chlorine.

Experiment 3:

With the same pickling acid as in Experiments 1 and 2 the Venturi was supplied with 16 l/h and the reactor with 8.2 l/h. The temperature in the burner plane now amounted to 554° C. and in the top of the reactor 390° C. The amount of gas was 2.1 $m^3$/h, the amount of air 28 $m^3$/h and this was now subjected to an increase in $O_2$ content to 12% (based on dry volume). After the first column a content of $Cl_2$ of 107 mg/m$^3$ waste gas was determined without the addition of nitrogenous compounds. It was thus shown that due to the increase of the oxygen content a substantial increase in the chlorine concentration can be detected.

Experiment 4:

In a further test, under the same conditions as in Experiment 3, 5.7 g/l ammonium chloride was added to the pickling acid fed to the venturi. In this case the chlorine determination, after the first column, yielded a clear reduction of the chlorine content as compared with Experiment 3 to 37 mg/m$^3$, i.e., a reduction of 65%.

WORKING EXAMPLE B

Experiment 1:

The experiment was conducted in an industrial spray roasting plant using the pickling acid of Working Example A, in which the temperature in the burner plane amounted to 600° C. and high up in the reactor 415° C. The feed rate for the reactor was 4500 l/h, the gas consumption 480 $m_3$/h, the air consumption 5570 m$^3$/h and the amount of waste gas was (at 85° C.) 12500 $m_3$/h.

In the flue the content of $NO_x$ was measured and an average value of 180 ppm was obtained, consisting of 150 ppm NO and 30 ppm $NO_2$. This corresponds to an overall amount of 2.5 kg NO/h.

Experiment 2:

To the pickling acid was added a 20% ammonium chloride solution as per the following table, the amount being increased step-wise. The equivalent amounts of $NH_4Cl$ were calculated according to the equation (5) for NO.

| $NH_3$/NO | NO content (ppm) |
|---|---|
| 1:1 | 160 |
| 2:1 | 100 |
| 3:1 | 80 |
| 6:1 | 50 |
| 10:1 | 25 |

Note: At the temperatures prevailing in the reactor ammonia ($NH_3$) is formed from $NH_4Cl$:

$$NH_4Cl \rightarrow NH_3 + HCl \quad (7)$$

Accordingly, depending on the prevailing $NH_3$ excess, a considerable reduction of the $NO_x$ content in the waste gas could be attained. The chemical processes associated with the use of other compounds which contain nitrogen having a low oxidation number, would be clear to an ordinarily skilled practitioner based on the reactions associated with the working examples.

What is claimed is:

1. In a process for the regeneration of hydrochloric acid used as a pickling acid in a pickling plant, wherein iron chloride is produced in said pickling plant and wherein said regeneration process includes the thermal decomposition of said iron chloride in the spent pickling acid into iron oxide and gaseous hydrochloric acid and molecular chlorine, the improvement comprising admixing with the spent pickling acid, at least one compound which contains nitrogen having a low oxidation number whereby said at least one compound reacts with said molecular chlorine to regenerate said hydrochloric acid and produce molecular nitrogen.

2. The process of claim 1, wherein the spent pickling acid is fed jointly with said at least one compound as an aqueous solution into a venturi scrubber and thereafter delivered as an aqueous solution to be thermally decomposed in a reactor.

3. The process of claim 2, wherein the step of thermally decomposing is performed in a spray roasting reactor.

4. The process of claim 1, wherein said thermal decomposition produces a waste gas and the improvement further comprises scrubbing the waste gas with rinse water from a pickling rinse plant which is located downstream of the pickling plant.

5. The process of claim 2, wherein said thermal decomposition produces a waste gas and the improvement further comprises scrubbing the waste gas with rinse water from a pickling rinsing plant which is located downstream of the pickling plant.

6. The process of claim 4, wherein said at least one compound is added to said rinse water from the rinsing plant prior to scrubbing the waste gas from the thermal decomposition.

7. The process of claim 5, wherein said at least one compound is added to said rinse water from the rinsing plant prior to scrubbing the waste gas from the thermal decomposition.

8. The process of claim 1, wherein the step of admixing at least one compound includes adding an amount of said at least one compound which is at least five times the stoichiometric amount to produce said hydrochloric acid and molecular nitrogen ($N_2$).

9. The process of claim 1, wherein the step of thermal decomposition produces nitrogen oxides and the step of admixing at least one compound includes adding an amount of said at least one compound which is at least two times the stoichiometric amount to produce molecular nitrogen ($N_2$) and water ($H_2O$) from said nitrogen oxides.

10. The process of claim 1, wherein the step of thermal decomposition produces nitrogen oxides and the step of admixing at least one compound includes adding an amount of said at least one compound which is at least two times the stoichiometric amount to produce hydrochloric acid from said molecular chlorine and molecular nitrogen ($N_2$) from said nitrogen oxides.

11. The process of claim 9, wherein the spent pickling acid is fed jointly with said at least one compound as an aqueous solution into a venturi scrubber and thereafter delivered as an aqueous solution to be thermally decomposed in a reactor.

12. In a process for the regeneration of hydrochloric acid used as a pickling acid in a pickling plant, wherein iron chloride is produced in said pickling plant and wherein said regeneration process includes the thermal decomposition of said iron chloride in the spent pickling acid into iron oxide and gaseous hydrochloric acid and molecular chlorine and further including the formation or nitrogen oxides, the improvement comprising admixing with the spent pickling acid, at least one compound which contains nitrogen which will react with said molecular chlorine and said nitrogen oxides to regenerate said hydrochloric acid and produce molecular nitrogen.

13. The process of claim 12, wherein the spent pickling acid is fed jointly with said at least one compound as an aqueous solution into a venturi scrubber and thereafter delivered as an aqueous solution to be thermally decomposed in a reactor.

14. The process of claim 13, wherein the step of thermally decomposing is performed in a spray roasting reactor.

15. The process of claim 12, wherein said thermal decomposition produces a waste gas and the improvement further comprises scrubbing the waste gas with rinse water from a pickling rinse plant which is located downstream of the pickling plant.

16. The process of claim 13, wherein said thermal decomposition produces a waste gas and the improvement further comprises scrubbing the waste gas with rinse water from a pickling rinsing plant which is located downstream of the pickling plant.

17. The process of claim 15, wherein said at least one compound is added to said rinse water from the rinsing plant prior to scrubbing the waste gas from the thermal decomposition.

18. The process of claim 16, wherein said at least one compound is added to said rinse water from the rinsing plant prior to scrubbing the water gas from the thermal decomposition.

19. The process of claim 12, wherein the step of admixing at least one compound includes adding an amount of said at least one compound which is at least five times the stoichiometric amount to produce hydrochloric acid and molecular nitrogen ($N_2$).

20. The process of claim 12, wherein the step of admixing at least one compound includes adding an amount of said at least one compound which is at least two times the stoichiometric amount to produce molecular nitrogen ($N_2$) and water ($H_2O$) from said nitrogen oxides.

21. The process of claim 20, wherein the step of admixing at least one compound includes adding an amount which is at least five times the stoichiometric amount to produce hydrochloric acid from said molecular chlorine and molecular nitrogen ($N_2$) from said nitrogen oxides.

22. The process of claim 20, wherein the spent pickling acid is fed jointly with said at least one compound as an aqueous solution into a venturi scrubber and thereafter delivered as an aqueous solution to be thermally decomposed in a reactor.

23. In a process for the regeneration of hydrochloric acid used as a pickling acid in a pickling plant, wherein iron chloride is produced in said pickling plant and wherein said regeneration process includes the thermal decomposition of said iron chloride in the spent pickling acid into iron oxide and gaseous hydrochloric acid and molecular chlorine and further including the formation or nitrogen oxides, the improvement comprising admixing with the spent pickling acid, at least one compound which contains nitrogen having a low oxidation number and selected from the group consisting of ammonium compounds, ammonia, urea, and amides.

24. The process of claim 23, wherein the spent pickling acid is fed jointly with said at least one compound as an aqueous solution into a venturi scrubber and thereafter delivered as an aqueous solution to be thermally decomposed in a reactor.

25. The process of claim 24, wherein the step of thermally decomposing is performed in a spray roasting reactor.

26. The process of claim 23, wherein said thermal decomposition produces a waste gas and the improvement further comprises scrubbing the waste gas with rinse water from a pickling rinse plant which is located downstream of the pickling plant.

27. The process of claim 24, wherein said thermal decomposition produces a waste gas and the improvement further comprises scrubbing the waste gas with rinse water from a pickling rinsing plant which is located downstream of the pickling plant.

28. The process of claim 26, wherein said at least one compound is added to said rinse water from the rinsing plant prior to scrubbing the waste gas from the thermal decomposition.

29. The process of claim 27, wherein said at least one compound is added to said rinse water from the rinsing plant prior to scrubbing the waste gas from the thermal decomposition.

30. The process of claim 23, wherein the step of thermal decomposition produces molecular chlorine ($Cl_2$), and the step of admixing at least one compound includes adding an amount of said at least one compound which is at least five times the stoichiometric amount to produce hydrochloric acid and molecular nitrogen ($N_2$).

31. The process of claim 23, wherein the step of thermal decomposition produces nitrogen oxides and the step of admixing at least one compound includes adding an amount of said at least one compound which is at least two times the stoichiometric amount to produce molecular nitrogen ($N_2$) and water ($H_2O$) from said nitrogen oxides.

32. The process of claim 31, wherein the step of thermal decomposition produces molecular chlorine ($Cl_2$), and the step of admixing at least one compound incudes adding an amount which is at least five times the stoichiometric amount to produce hydrochloric acid from said molecular chlorine and molecular nitrogen ($N_2$) from said nitrogen oxides.

33. The process of claim 31, wherein the spent pickling acid is fed joint with said at least one compound as an aqueous solution into a venturi scrubber and thereafter delivered as an aqueous solution to be thermally decomposed in a reactor.

* * * * *